US006296781B1

(12) United States Patent
Amiran

(10) Patent No.: US 6,296,781 B1
(45) **Date of Patent: *Oct. 2, 2001**

(54) FIRE RETARDANT AND FIRE EXTINGUISHING MATERIAL

(75) Inventor: Mohsen C. Amiran, Des Plaines, IL (US)

(73) Assignee: BioGenesis Enterprises, Inc., Springfield, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/850,345

(22) Filed: May 2, 1997

(51) Int. Cl.[7] ..... A62D 1/04; A62D 1/02
(52) U.S. Cl. ..... 252/8.05; 252/2; 252/3
(58) Field of Search ..... 252/2, 3, 8.05, 252/607, 610, 611

(56) References Cited

U.S. PATENT DOCUMENTS 4,042,522 * 8/1977 Falk ..... 252/8.05
5,061,383 * 10/1991 Friloux et al. ..... 252/3
5,110,585 * 5/1992 Chaudhuri et al. ..... 424/70
5,225,095 * 7/1993 DiMaio et al. ..... 252/8.05
5,391,721 * 2/1995 Hanen et al. ..... 252/3
5,585,028 12/1996 Berger .

* cited by examiner

*Primary Examiner*—Joseph D. Anthony
(74) *Attorney, Agent, or Firm*—Birch, Stewart, Kolasch & Birch, LLP

(57) ABSTRACT

A novel composition for the control of fire is disclosed. The novel composition can be used as a fire extinguisher or as a fire retardant. The composition is prepared by the admixture of a preferred amount of a selected emollient, a preferred amount of a selected emulsifier, and a preferred amount of a selected dispersant in a water carrier. To the minimal mixture may be added a preferred amount of a selected oxygen competitor, a preferred amount of a selected coolant, a preferred amount of a selected radical scavenger, or a preferred amount of a selected oxygen depleting compound. In the most preferred embodiment all of the foregoing are admixed together in a water carrier.

The resulting composition functions well as a fire extinguisher by extinguishing flame. It also acts as an effective fire retardant when applied to a flammable material as a prophylactic procedure. In these instances, it is best to apply the composition to the surface of the flammable material between the surface of the flammable material and any available oxygen source.

11 Claims, No Drawings

FIRE RETARDANT AND FIRE EXTINGUISHING MATERIAL

BACKGROUND OF THE INVENTION

1. Field of the Invention

The present invention relates to a fire extinguishing agent for fire retardency and fire extinguishing purposes. The agent exhibits a high flame control ability, and can effectively extinguish and/or retard fires from hydrophobic and hydrophilic combustible liquids. The fire extinguishing agent of the present invention also possesses various characteristics in that it is a non-toxic material, will have little deterioration under prolonged storage, is effective at extinguishing fires of hydrophilic combustible liquids even when used in high dilution forms, and does not form a toxic material after use in fire fighting applications.

2. Description of the Prior Art

In general, foam type fire extinguishing agents have been used to extinguish fires of flammable liquids. These include hydrophilic combustible liquids such as alcohols, ketones, ethers, and the like. In addition, fire extinguishing agents can be used for combatting combustion of certain other materials such as gasoline and other fuel sources. The disadvantage of most fire extinguishers for such liquid fuel fires is that the fire antagonist is required in large volume for the purpose of extinguishing a fire. This is because the fire extinguishing agent must limit the access of oxygen to the fuel source, as by a foam barrier. Alternatively, the fire extinguishing agent must act to cool the material below the flash or combustion point.

This latter effect may require large quantities of material in order to reduce the temperature of the flammable material below the combustion point.

The disadvantage of these fire extinguishing agents is that they are comprised of or contain highly toxic materials. Many fires such as flammable fuel fires and the like should be contained very rapidly to avoid water-fuel mixture run-off from the fire site.

Prior fire extinguishing compounds such as AFFF are not readily useable for the reason that these fire extinguishing materials contain toxic or hazardous substances which should be prevented from runoff or from entering the water table. Toxics also can be volatilized in the initial application to a fire due to heat.

In the past, fire extinguishing agents also have been used with the decomposition composition products of natural proteins wherein the base material includes metal soaps and a dispersing agent. The disadvantage of these materials is that the chemicals contained within them are dangerous to humans and other life forms, and deterioration of the functionality of the product often occurs. This happens either through corrosion of the vessels containing the fire fighting material or deterioration of product through precipitation and separation during prolonged storage.

These foams may be alcohol resistant, but as such, the foam is hard and caky and does not spread readily over the entire burning area.

Other extinguishing agents possess no foaming ability. These are fire extinguishing agents in which metal soaps are solubilized and dispersed in synthetic surfactants. Although these materials are in a very high dilution such as the 3% to 5% dilution, large quantities of these agents are required to obtain a fire extinguishing result. In addition, these agents are not uniformly effective as against highly flammable material such as acetone.

Other fire extinguishing agents contain water and soluble polymers in addition to surface surfactant agents (including fluorinated aliphatic materials) and other foaming agents. These fire extinguishing agents form a gelatinous mat which inhibits the spreadability of the foam while performing its fire extinguishing function. Frequently the gelatinous material that is formed also contains within it fairly high concentrations of hazardous materials and therefore this is not a preferred fire extinguishing material. Furthermore, these materials may require specific and special storage conditions to avoid degradation during prolonged storage. These materials are also extremely expensive and must be handled with great care.

In all of these fire extinguishing materials, degradation during prolonged storage is a severe problem that limits the effectiveness of a material for fire retardency or fire extinguishing purposes.

Until the 1970's, the components of the present invention were not even known. The present invention contains a unique combination of chemicals within it which provides for excellent fire extinguishing properties and obtains an excellent result while avoiding release of toxic or hazardous chemicals into the environment.

In addition, present fire extinguishing materials tend to function by wetting down the flames in order to cool the flammable material to a point below its combustion temperature. This often requires the introduction of large quantities of water in addition to the foam, presenting an admixture type of situation wherein the fire extinguishing foam is admixed into the flammable materials in conjunction with a large quantity of water. Often after a fire is extinguished, the material left behind must be separated to prevent or contain runoff of toxic or hazardous materials. Separation of these various fractions is often times difficult. The result is if the fire has occurred on soil, all of the soil may be required to be disposed of at great cost in a hazardous waste landfill to avoid further contamination of the environment.

In addition, many of the foam fire extinguishers which are produced have a high tendency to flow away from a fire. This means a large quantity of foam or fire extinguishing material must be introduced to the fire site within the flammable material in order to adequately quench the fire and reduce the amount of burning material involved in the fire. As a result, there is a longer burn and a greater quantity of flammable material that burns. Also, a greater amount of foam or fire extinguishing material is consumed or applied to a fire in order to extinguish flame.

The present invention avoids all of these problems while presenting a fire extinguishing compound that can be stored in readily available containers. Prolonged storage of the fire extinguishing compound of this invention does not result in degradation or loss of effectiveness. In addition, the material can be packaged for consumer use because it is not comprised of any hazardous materials and can be used safely around children. The effectiveness of the invention also presents a distinct advantage over standard fire extinguishers for a variety of classes of fires, in that this material more readily controls flames in a fire for the purpose of containing burning. This invention also avoids the unnecessary addition of flame retardant or fire extinguishing agents to a quantity of burning material.

II. SUMMARY OF INVENTION

The present invention is an effective fire extinguishing material that is comprised of materials that lower the temperature of the burning material more effectively than water alone; compete for oxygen to counteract the oxidation process yielding flame and has other components that assist in the distribution of material from the dispensing container to direct the material effectively to the flammable material. This material may also be used to prevent burning by acting as a coolant and oxygen competitor to prevent the flammable material from reaching flash point.

In another embodiment of the invention, the fire extinguishing material is comprised of a coolant and water admixture, combined with a selected radical scavenger, a selected oxygen depleting compound, a selected emollient, a selected dispersant; a selected emulsifier, and a selected oxygen competitor.

The practitioner of this invention will preferably use components from each of the following categories of substances as follows. The selected radical scavenger and the selected oxygen depleting component should be employed in a range between about 0.2 weight percent and about 5 weight percent in total for the two categories combined.

The selected emollient in combination with the selected dispersant and the selected emulsifier are used in a combined percent of about 0.8 weight percent to about 10 weight percent.

The selected oxygen competing compound should be employed in this invention in an amount in the range between about 0.1 weight percent and 2 weight percent.

Finally, the water and cooling chemical combined should be in a range of about 85 weight percent to about 98 weight percent. The water component should range between about 72 weight percent to about 95 weight percent.

In all, the sum of the foregoing components should be not more than 100 percent. The components of the fire extinguishing material can be compounded in any order. It is most preferred to compound the material by adding the various components to the water carrier.

The fire extinguishing material can be packaged in any of a variety of materials. When formulated according to the practice of this invention, the material is non-toxic and non-corrosive. The material formed in the practice of this invention is also useful for long term storage and does not require special storage vessels or special handling.

III. DETAILED DESCRIPTION OF THE INVENTION

The present invention provides an effective fire extinguisher composition that controls flames and control flammability in a variety of flammable materials. The present invention is primarily an aqueous chemical composition that functions to lower the temperature of the burning material and/or to prevent oxidation within a flame so as to control and extinguish fire.

The present invention is comprised of water plus a cooling chemical or cooling agent; emollients, dispersants and emulsifiers; an oxygen depleting substance (or radical scavenger); and a flammability competitor. Specific examples of these materials are set forth herein.

In general, the compounding of the various components of this invention should be done by mixing certain materials together and then mixing these materials with water. There is a preferred order of mixing, however, the invention will function in the absence of following these precise instructions. For maximal effect, a mixture of water and cooling materials is first prepared. To the water and cooling material is added a mixture of radical scavenger and oxygen depleting compound. In this step, the radical scavenger composition and the oxygen depleting compound are mixed together and then admixed with the water and cooling chemical admixture.

To the resulting mixture is added another mixture comprised of an emollient substance, a dispersant, and a solubilizer. In this step, the selected emollient, the selected dispersant and the selected emulsifier are mixed together to form an admixture. These are added to the previously obtained water cooling chemical and radical scavenger oxygen depleting compound admixture.

Finally, a selected oxygen competitor is added to the resulting mixture of the prior three mixing steps. That is the water and cooling chemical admixture has had added to it the admixture of radical scavenger and oxygen depleting compound and then had added to it the emollient, dispersant and solubilizer. This forms an admixture also. The resulting compound is then ready for packaging or may be placed in large tanks for on-site storage.

In certain circumstances, the package you may wish to make a concentrated solution. For these applications, the full amount of the recommended cooling compound is admixed with ¼ to ½ of the water ordinarily supplied for creating a fire extinguisher material. The other materials are admixed with the water and a concentrate is thus formed.

The fire extinguishing compound of this invention is minimally comprised of a surfactant and emulsifier in a water carrier. This particular configuration can be used on oil fires. In this embodiment, the surfactant is added to the mixture in the range of about 0.8 weight percent to about 10 weight percent. This admixture also contains emulsifier in the amount of about 0.8 weight percent to about 10 weight percent.

To the foregoing can be added an effective amount of a selected oxygen competitor that aids in the function of the product in competition with the oxygen required for flame; an emollient, alone or in combination with an effective amount of a dispersant for the purpose of improving mixability and flow; and a radical scavenger, alone or in combination with an oxygen depleting substance. All of the foregoing are admixed in an effective amount of a water carrier. The water carrier may also be augmented by the addition of an effective amount of a coolant material for the purpose of reducing the temperature of the flame or burning material.

The radical scavenger is added to the mixture in a range between about 0.2 weight percent and about 5 weight percent. The oxygen depleting compound is added in an amount in the range of between about 0.2 weight percent and about 5 weight percent.

To the foregoing is also added an effective amount of a selected oxygen competing compound. The oxygen competitor is added in the amount of about 0.1 weight percent to about 2 weight percent.

The cooling effect of water is increased by the addition of a cooling chemical in the amount of about 2 weight percent to about 15 weight percent.

In an alternative embodiment, this novel fire extinguishing compound can be made in a concentrated form, and which is then diluted upon either packaging or immediately prior to dispersal for fire extinguishing. In these situations, the various components are added to the water carrier, and additional water is added immediately prior to packaging. Alternatively, the concentrate can be mixed in a dispensing device that provides for the introduction of the proper amount of water to dilute the concentrate to the proper concentration in water, at or immediately prior to the fire extinguishing material being discharged to the fire.

The Examples herein provide for mixing the various ingredients into a water carrier. The practitioner may combine the various components in any order, as may be desired. However, generally it is preferred to mix the water and cooling chemical, then mix the other materials into the water-cooling agent mixture.

Also, the practitioner may combine the components, only using a portion of the water. Additional water can be added to the mixture at any stage of adding component ingredients for purposes of achieving the proper concentration of components to water. In addition, the concentrated format may be used to lower shipping costs, by allowing the addition of water at the packaging point or sales point.

In the preparation of the fire extinguisher or wetting agent of this invention, a cooling agent was added to water to enhance the cooling effect of the water. Water functions in most fire fighting applications as a coolant. However, the heat capacity of water can be increased and its cooling capacity increased by the addition of a cooling compound. Among them are those listed here, which are set forth by way of example and not by way of limitation. Appropriate cooling agents that can be added are: ethylene glycol; propylene glycol; polypropylene glycol; organic alcohols having C=8 or greater; and the like as are well known in the art.

Free radical scavengers were then added to the present invention for purposes of flame and flammability control. Among them are those listed here, which are set forth by way of example and not by way of limitation. Appropriate radical scavengers are: tocopherol (vitamin E); phenol derivatives such as: 2-6 isopropyl isoprotyl 4 methyl phenol or phenol 2-6 T butyl 4 methyl phenols (BHT); 2-4-6 tri alkyl phenols such as: 2-4-6 trimethyl phenols; 2-4-6 tri ethyl phenols; 2-6 diethyl 4 methyl phenol; quinone derivatives such as: 1,2-benzoquinone or 1,4-benzoquinone. Additional free radical scavengers such as p-methylamino phenol and vitamin K may also be employed.

Oxygen depleting compounds were then added in an effective amount to interfere with the oxidation reaction within the flame of burning materials. Among them are those listed here, which are set forth by way of example and not by way of limitation. Such oxygen depleting substances are: a modified alkanolamide such as Actramide from Climax Performing Manufacturing Company; modified cocoamide such as Norfox DCO from Norman Fox and Company; fatty acid alkanolamide such as: Hostacor-DET or HOR2098 from Hoechst; aromatic phosphate esters such as: Hostaphat AW from Hoechst; sulfonated coconut derivative sodium salts such as Miranol CS from Rhone-Poulenc; or sulfonated caprylic derivative sodium salts such as Miranol J. S. from Rhone-Poulenc.

A wide variety of emollients are appropriate for inclusion in this invention. Among them are those listed here, which are set forth by way of example and not by way of limitation. Among those which can be used within this invention are: glycerine; propylene glycol; sucrose distearate; tocopherol; polyethylene glycol succinate; oil of egg; wheat germ oil; lanolin alcohol; ethoxylated lanolin; isopropyl palmitate; ethoxylated sterol; ethoxylated glucose derivative; polyoxylated glucose derivative; isopropyl stearate and non-linear alcohols having about C=7 to about C=28.

Additional emollients that can be used are: alkoxylated lanolin; PEG 15-50 hydrogenated lanolin; PPG 15-50 hydrogenated lanolin; calcium stearoyl lactylate; cetyl octanoate; myreth-3 laurate; PEG 5 to 25 caprylic glyceride; PPG 5-25 capric glyceride; PPG 5-25 caprylic glyceride; PPG 5-25 capric glyceride; polyoxyethylene cholesterol (15-35 E.O; ethoxylated glycol; sucrose cocoate and cetyl alcohol.

Emulsifiers(which may also be referred to as solubilizing agents or solubilizers) are used to improve mixing in the water carrier. Certain of the preferred emulsifiers that can be used in the present invention are: disodium ethoxylated nonyl phenol half ester of sulfosuccinic acid; hydrogenated castor oil; PEG 60 such as Cremophor RH-60 or RH-40 from BASF Corporation; sodium dodecyl diphenyloxide disulfonate such as DowFax 2A1 or C66 or 3B2 from Dow Chemical; tocopherol polyethylene glycol 1000 succinate such as Eastman TPGS Vitamin E; polysorbate 80 such as Liposorb 0-20 or Liposorb-20 (Lipo Chemicals Inc.); P.O.E. (20) sorbitan monooloate (polysorbate 20-80) such as Tween 80 or Tween 20.

The function of oxygen competition is also provided for in this invention. An oxygen competitor was added to aid in the control of the rapid oxidation reaction in flame. By this means, the oxidation reaction of fire is reduced. Many chemicals can be used as oxygen competitors. Among them are those listed here, which are set forth by way of example and not by way of limitation.

Appropriate compounds which are used to compete with the flammable material for fuel or to prevent the oxidation of this material by competing for the oxidation reaction which is the essence of flame are as follows. These materials include, but are not limited to, polyamine including its organic or inorganic salt; polypeptides; polyamides; polysaccharides; or compounds such as pyrrolidone and its derivatives, pyrroles and directives; uracil; furan and its derivatives; guanine; or a selected EDTA derivative. Various samples have been obtained by combining the materials as set forth herein. These various combinations will be discussed in specific examples which are presented for purposes for illustration but not for purposes of limitation.

Each of the succeeding Examples is formulated using water as a carrier for the other components. Water is the most preferred carrier. Other carriers may be employed, but water has the advantage of being an appropriate agent for a wide variety of fires and is applicable to a wide range of fuels for purposes of controlling the flammability or for extinguishing flame. The effect of water as a coolant, to reduce the temperature of the fuel is enhanced by incorporation of coolants, as is discussed herein. In addition, the reactivity of water with certain materials can be adjusted through the addition of additives to effect an increase or decrease in the cooling capacity of water, to increase or decrease the miscibility of water with a variety of materials.

The quantity of water may vary, based upon weight percent. The amounts of water may also be influenced by the amount of ingredient necessary to obtain a cooling effect when the water is placed in contact with the fire. The cooling effect of water is herein defined as the effect of water in lowering the temperature of a material by means of the water being in substantial contact with the material. This effect can be obtained either through direct contact between the water and the substance that is cooled, or through the enhancing the cooling effect of the water so as to cool the immediate area of application, thereby causing heat to dissipate from the substance. The cooling effect of water acts to reduce the temperature of the burning material below the flash or ignition point. This results in a reduction of burning capability.

Each of the following examples is prepared by admixing or combining certain components as set forth. Each example is prepared on weight percent basis. Other compounding methods can be applied to the performance of this invention without departing from the spirit of the invention disclosed herein. In certain of the Examples, the amounts given here are expressed in ranges for the reason that precise amounts are not always required, as the invention functions very well when amounts of components are added within the range given. In all instances the amounts of the various components must total 100%. In certain situation, the amount of water and cooling material will yield an amount of water in the range of 85%–98%. Taken without the cooling material, the amount of water alone may range between 73% and 98%.

EXAMPLE 1

A fire extinguishing composition was prepared by admixing the following ingredients in the amounts shown:

| | |
|---|---|
| water | 85 wt. % |
| propylene glycol | 1 wt. % |
| quinone | 2 wt. % |
| sulfonated caprylic sodium salt | 3 wt. % |
| sodium polyacrylate | 2 wt. % |
| polyoxyethlyene (20) sorbitan monolaurate (Tween 20) | 3 wt. % |
| pyrolidone (2-methyl) | 4 wt. % |

EXAMPLE 2

A fire extinguishing composition was prepared by admixing the following ingredients in the amounts shown:

| | |
|---|---|
| propylene glycol | 0.25 wt. % |
| water | 95.59 wt. % |
| quinone | 0.01 wt. % |
| sulfonated caprylic sodium salt | 0.6 wt. % |
| sodium polyacrylate | 1.4 wt. % |
| polyoxyethylene (20) sorbitan monolaurate (Tween 20) | 1.15 wt. % |
| pyrolidone (2-methyl) | 0.1 wt. % |

EXAMPLE 3

A fire extinguishing composition was prepared by admixing the following ingredients in the amounts shown:

| | |
|---|---|
| propylene glycol | 3.3 wt. % |
| water | 83.3 wt. % |
| quinone | 2.5 wt. % |
| sulfonated caprylic sodium salt | 2.5 wt. % |
| sodium polyacrylate | 3.3 wt. % |
| polyoxyethylene (20) sorbitan monolaurate (Tween 20) | 3.3 wt. % |
| pyrolidone (2-methyl) | 2.5 wt. % |

EXAMPLE 4

A fire extinguishing composition was prepared by admixing the following ingredients in the amounts shown:

| | |
|---|---|
| phenol | .01 wt. % |
| water | 96.19 wt. % |
| tocopherol* | .1 wt. % |

-continued

| | |
|---|---|
| aromatic phosphate ester | 1 wt. % |
| lanolin alcohol | .1 wt. % |
| 2 ethyl-hexyl sulfate | 2 wt. % |
| P.O.E. 20 (sorbitan mono-9-octadecanoate poly(oxy-1,2-ethanediol) | .1 wt % |
| pyrolidone (2-methyl) | .5 wt. % |

*Note: a racemic mixture may be employed.

EXAMPLE 5

A fire extinguishing composition was prepared by admixing the following ingredients in the amounts shown:

| | |
|---|---|
| phenol | 1 wt. % |
| water | 88 wt. % |
| tocopherol* | 1 wt. % |
| aromatic phosphate ester | 2 wt. % |
| lanolin alcohol | 4 wt. % |
| 2 ethyl-hexyl sulfate | 3 wt. % |
| P.O.E. 20 (sorbitan mono-9-octadecanoate poly(oxy-1,2-ethanediyl) | 3 wt % |
| pyrolidone (2-methyl) | 4 wt. % |

*A racemic mixture may be employed.

EXAMPLE 6

A fire extinguishing composition was prepared by admixing the following ingredients in the amounts shown:

| | |
|---|---|
| phenol | .1 wt. % |
| water | 86.0 wt. % |
| tocopherol* | 1.8 wt. % |
| lanolin alcohol | 2 wt. % |
| 2 ethyl-hexyl sulfate | 4 wt. % |
| P.O.E. 20 (sorbitan mono-9-octadecenoate poly(oxy-1,2-ethanediol) | 2 wt % |
| aromatic phosphate ester | 4 wt. % |
| pyrolidone (2-methyl) | .1 wt. % |

*A racemic mixture may be employed.

EXAMPLE 7

A fire extinguishing composition was prepared by admixing the following ingredients in the amounts shown:

| | |
|---|---|
| water | 88.89 wt.% |
| quinone | 0.1 wt. % |
| cocoamide | 2 wt. % |
| glycerin | 1 wt. % |
| ethoxylated glycol | 2 wt. % |
| polyethylene glycol | 4 wt. % |
| disodium ethoxylated nonylphenol | 2 wt. % |
| pyrrole | 0.01 wt. % |

EXAMPLE 8

A fire extinguishing composition was prepared by admixing the following ingredients in the amounts shown:

| | |
|---|---|
| water | 89.8 wt. % |
| quinone | .2 wt. % |
| cocoamide | 0 wt. % |
| glycerin | 4 wt. % |
| ethoxylated glycol | 7 wt. % |
| polyethylene glycol | 5 wt. % |
| disodium ethoxylated nonylphenol | 5 wt. % |
| pyrrole | 0 wt. % |

EXAMPLE 9

A fire extinguishing composition was prepared by admixing the following ingredients in the amounts shown:

| | |
|---|---|
| water | 88.89 wt. % |
| quinone | 0.1 wt. % |
| cocoamide | 2 wt. % |
| glycerin | 1 wt. % |
| ethoxylated glycol | 2 wt. % |
| polyethylene glycol | 4 wt. % |
| disodium ethoxylated nonylphenol | 2 wt. % |
| pyrrole | 0.01 wt. % |

EXAMPLE 10

A fire extinguishing composition was prepared by admixing the following ingredients in the amounts shown:

| | |
|---|---|
| water | 91.95 wt. % |
| cocoamide | 8 wt. % |
| quinone | 0.05 wt. % |
| glycerin | 1 wt. % |
| ethoxylated glycol | 6 wt. % |
| polyethylene glycol | 0 wt. % |
| disodium ethoxylated nonylphenol | 2. wt. % |
| pyrrole | 2.0 wt. % |

EXAMPLE 11

A fire extinguishing composition was prepared by admixing the following ingredients in the amounts shown:

| | |
|---|---|
| water | 87.8 wt. % |
| tocopherol | .2 wt. % |
| aromatic phosphate ester | 2 wt. % |
| sucrose distearate | .1 wt. % |
| 2 ethyl hexyl alcohol | .2 wt. % |
| non linear alkane sulfate | .7 wt. % |
| nonyl phenol PEG ether | 4 wt. % |
| Tween 80 | 2 wt. % |
| polysaccharide | 3 wt. % |

EXAMPLE 12

A fire extinguishing composition was prepared by admixing the following ingredients in the amounts shown:

| | |
|---|---|
| water | 87.7 wt. % |
| tocopherol | .2 wt. % |

-continued

| | |
|---|---|
| aromatic phosphate ester | 2 wt. % |
| sucrose distearate | .5 wt. % |
| 2 ethyl hexyl alcohol | .1 wt. % |
| non linear alkane sulfate | .5 wt. % |
| nonyl phenol PEG ether | .5 wt. % |
| Tween 80 | .5 wt. % |
| polysaccharide | 8 wt. % |

EXAMPLE 13

A fire extinguishing composition was prepared by admixing the following ingredients in the amounts shown:

| | |
|---|---|
| propylene glycol | 5 wt. % |
| water | 78 wt. % |
| p-methylamino phenol | 1 wt. % |
| 2 ethylhexyl sulfate | 12 wt. % |
| polysorbate 80 | 5 wt. % |
| polypeptide | 4 wt. % |

EXAMPLE 14

A fire extinguishing composition was prepared by admixing the following ingredients in the amounts shown:

| | |
|---|---|
| propylene glycol | 5 wt. % |
| water | 87 wt. % |
| p-methylamino phenol | 1 wt. % |
| p-methylamino phenol | 1 wt. % |
| 2 ethylhexyl sulfate | 10 wt. % |
| polysorbate 80 | 1 wt. % |
| polypeptide | 1 wt. % |

EXAMPLE 15

A fire extinguishing composition was prepared by admixing the following ingredients in the amounts shown:

| | |
|---|---|
| propylene glycol | 5 wt. % |
| water | 88 wt. % |
| p-methylamino phenol | 1 wt. % |
| 2 ethylhexyl sulfate | 4 wt. % |
| polysorbate 80 | 2 wt. % |
| polypeptide | 0 wt. % |

EXAMPLE 16

A fire extinguishing composition was prepared by admixing the following ingredients in the amounts shown:

| | |
|---|---|
| propylene glycol | 6 wt. % |
| water | 87.8 wt. % |
| p-methylamino phenol | 2 wt. % |
| sulfonated caprylic derivative sodium salt | 2 wt. % |
| hydrogenated castor oil PEG 60 | 0.1 wt. % |
| isopropyl palmitate | .1 wt. % |
| 2-pyrrolidone | 2 wt. % |

EXAMPLE 17

A fire extinguishing composition was prepared by admixing the following ingredients in the amounts shown:

| | |
|---|---|
| propylene glycol | 6 wt. % |
| water | 74 wt. % |
| sulfonated caprylic derivative sodium salt | 2 wt. % |
| p-methylamino phenol | 1 wt. % |
| hydrogenated castor oil PEG 60 | 10 wt. % |
| isopropyl palmitate | 6 wt. % |
| 2-pyrrolidone | 1 wt. % |

EXAMPLE 18

A fire extinguishing composition was prepared by admixing the following ingredients in the amounts shown:

| | |
|---|---|
| propylene glycol | 2 wt. % |
| water | 87.7 wt. % |
| sulfonated caprylic derivative sodium salt | .1 wt. % |
| p-methylamino phenol | 2 wt. % |
| hydrogenated castor oil PEG 60 | 8 wt. % |
| isopropyl palmitate | .1 wt. % |
| 2-pyrrolidone | .1 wt. % |

EXAMPLE 19

A fire extinguishing composition was prepared by admixing the following ingredients in the amounts shown:

| | |
|---|---|
| propylene glycol | 6 wt. % |
| water | 80.0 wt. % |
| p-methylaniino phenol | 2 wt. % |
| sulfonated caprylic derivative sodium salt | 5 wt. % |
| hydrogenated castor oil PEG 60 | 5 wt. % |
| isopropyl palmitate | .5 wt. % |
| 2-pyrrolidone | 1.5 wt. % |

EXAMPLE 20

A fire extinguishing composition was prepared by admixing the following ingredients in the amounts shown:

| | |
|---|---|
| 2 ethyl hexyl alcohol | 10 wt. % |
| water | 85.6 wt. % |
| p-aminophenol | 1.1 wt. % |
| tocopherol polyethylene glycol 1000 succinate | .6 wt. % |
| lanolin alcohol | 2 wt. % |
| POE 80 sorbitan monolaurate | 0.2 wt. % |
| ammonia polyacrylate | 0.2 wt. % |
| pyrrole | 0.2 wt. % |

EXAMPLE 21

A fire extinguishing composition was prepared by admixing the following ingredients in the amounts shown:

| | |
|---|---|
| 2 ethyl hexyl alcohol | 10 wt. % |
| water | 86.6 wt. % |
| p-aminophenol | .1 wt. % |
| tocopherol polyethylene glycol 1000 succinate | .1 wt. % |
| POE 80 sorbitan monolaurate | .2 wt. % |
| ammonia polyacrylate | .2 wt. % |

-continued

| | |
|---|---|
| lanolin alcohol | 4 wt. % |
| pyrrole | 1 wt. % |

EXAMPLE 22

A fire extinguishing composition was prepared by admixing the following ingredients in the amounts shown:

| | |
|---|---|
| 2 ethyl hexyl alcohol | 1 wt. |
| water | 80 wt. % |
| p-aminophenol | 2 wt. % |
| tocopherol polyethylene glycol 1000 succinate | 3 wt. % |
| lanolin alcohol | 8 wt. % |
| POE 80 sorbitan monolaurate | 1 wt. % |
| ammonia polyacrylate | 1 wt. % |
| pyrrole | 4 wt. % |

EXAMPLE 23

A fire extinguishing composition was prepared by admixing the following ingredients in the amounts shown:

| | |
|---|---|
| 2 ethyl hexyl alcohol | 1 wt. % |
| water | 92.3 wt. % |
| p-aminophenol | .2 wt. % |
| tocopherol polyethylene glycol 1000 succinate | .2 wt. % |
| POE 80 sorbitan monolaurate | .4 wt. % |
| ammonia polyacrylate | .4 wt. % |
| lanolin alcohol | 4 wt. % |
| pyrrole | .5 wt. % |

EXAMPLE 24

A fire extinguishing composition was prepared by admixing the following ingredients in the amounts shown:

| | |
|---|---|
| 2 ethyl hexyl alcohol | 7 wt. % |
| water | 77.9 wt. % |
| p-aminophenol | 1 wt. % |
| tocopherol polyethylene glycol 1000 succinate | 4 wt. % |
| POE 80 sorbitan monolaurate | 2 wt. % |
| ammonia polyacrylate | 5 wt. % |
| lanolin alcohol | 3 wt. % |
| pyrrole | 0.1 wt. % |

EXAMPLE 25

A fire extinguishing composition was prepared by admixing the following ingredients in the amounts shown:

| | |
|---|---|
| propylene glycol | 2 wt % |
| water | 95.2 wt.% |
| modified cocoamide (eg. Norfox DCO from Norman Fox & Co. | 0.1 wt. % |
| quinone (1,2-benzoquinone | 0.1 wt. % |
| disodium ethoxylated nonylphenol | 0.2 wt. % |
| non-linear alkane sulfate (eg Witcolate D510) | 2 wt. % |

-continued

| | |
|---|---|
| polypoxylated 25 glucose | 0.1 wt. % |
| myreth −3 laurate | 0.1 wt. % |
| 2 pyrrolidone | 0.2 wt. % |

EXAMPLE 26

A fire extinguishing composition was prepared by admixing the following ingredients in the amounts shown:

| | |
|---|---|
| propylene glycol | 6 wt. % |
| water | 73 wt. % |
| quinone (1,2-benzoquinone | 2 wt. % |
| modified cocoamide (eg. Norfox DCO from Norman Fox & Co. | 3 wt. % |
| disodium ethoxylated nonylphenol | 2 wt. % |
| non-linear alkane sulfate (eg Witcolate D510 | 2 wt. % |
| polypoxylated 25 glucose | 6 wt. % |
| myreth −3 laurate | 2 wt. % |
| 2 pyrrolidone | 4 wt. % |

EXAMPLE 27

A fire extinguishing composition was prepared by admixing the following ingredients in the amounts shown:

| | |
|---|---|
| propylene glycol | 5 wt. % |
| water | 82.2 wt. % |
| quinone (1,2-benzoquinone | 1.4 wt. % |
| modified cocoamide (eg. Norfox DCO from Norman Fox & Co. | 2 wt. % |
| polypoxylated 25 glucose | 1 wt. % |
| myreth −3 laurate | 1.5 wt. % |
| disodium ethoxylated nonylphenol | .4 wt. % |
| non-linear alkane sulfate (eg Witcolate D510) | 4 wt. % |
| 2 pyrrolidone | 2.5 wt. % |

EXAMPLE 28

A fire extinguishing composition was prepared by admixing the following ingredients in the amounts shown:

| | |
|---|---|
| propylene glycol | 2 wt. % |
| water | 79.8 wt. % |
| quinone (1,2-berizoquinone | 2 wt. % |
| modified cocoamide (eg. Norfox DCO from Norman Fox & Co. | .2 wt. % |
| polypoxylated 25 glucose | 6 wt. % |
| myreth −3 laurate | 1 wt. % |
| disodium ethoxylated nonylphenol | 3 wt. % |
| non-linear alkane sulfate (eg Witcolate D510) | 3 wt. % |
| 2 pyrrolidone | 4 wt. % |

EXAMPLE 29

A fire extinguishing composition was prepared by admixing the following ingredients in the amounts shown:

| | |
|---|---|
| propylene glycol | 5 wt. % |
| water | 78.8 wt. % |

-continued

| | |
|---|---|
| quinone (1,2-benzoquinone | 0.8 wt. % |
| modified cocoamide (eg. Norfox DCO from Norman Fox & Co. | .1 wt. % |
| polypoxylated 25 glucose | 0.1 wt. % |
| myreth −3 laurate | 0.1 wt. % |
| disodium ethoxylated nonylphenol | 10 wt. % |
| non-linear alkane sulfate (eg Witcolate D510) | .1 wt. % |
| 2 pyrrolidone | 3 wt. % |

In each of the foregoing examples, the fire extinguishing composition derived from the preparation can be applied to a fuel source to act as a fire retardant. In such instances, the composition may be applied to a fuel source, whether or not the fuel source is a liquid or solid, for purposes of preventing flame. The fire extinguishing composition can also be applied to a fuel source that is partially in flame to prevent the spread of flame.

An advantage of the novel fire extinguishing composition of this invention is that the fire extinguishing composition does not form any emulsified layer with a fuel source. Thus the fuel, if a liquid such as gasoline or jet fuel, is not degraded following the application of the fire extinguishing composition. In this way, the liquid fuel can be recovered, by means such as vacuuming or other collection methods known in the art. Following collection, the fuel and fire extinguishing combination can be directed to a storage tank where the fire extinguishing composition will readily separate into a discrete water layer while the fuel will separate into a discrete hydrocarbon layer. This is a particular advantage over such fire extinguishing compositions such as AFFF which forms an emulsified layer with fuel.

A further advantage of the within invention is that whether used as a fire extinguishing agent or as a fire retardant, the novel composition is comprised of non-toxic components that remain non-toxic in combination. Therefore, the material presents the advantage of being environmentally safe, while allowing the substantially complete recovery of fuel.

An additional benefit is the fact that the fire extinguishing composition of this invention is non-corrosive. It is therefore useful for extinguishing fires in or near equipment that could be degraded by the corrosive effects of other conventional fire extinguishers. Also, as a non-toxic substance, the material can be washed into storm or sanitary sewers with no harmful effects. Thus, use of the within invention is without the risk of harmful side effects and the containment of the fuel source to prevent runoff of liquid fuels is the paramount concern. If there are means to collect the fire extinguishing or fire retardant material in conjunction with the fuel source, the low miscability will ensure that the fuel source and composition of this invention will separate into discrete phases. The composition of this invention also dries leaving virtually no residue, so there is low risk of surface contamination by the fire extinguishing material.

This disclosure in conjunction with the claims, is prepared for purposes of illustration. Other variations and modifications may be derived which do not depart from the scope or spirit of the claims of this invention.

What is claimed is:

1. A fire extinguishing composition, comprising:

an effective amount of a dispersant selected from the group consisting of sodium polyacrylate, ammonium polyacrylate, polyethylene glycol, polyacrylic acid, nonyl-phenyl PEG ether, sorbitan mono-laurate, polyethylene glycol monostearate, non-linear alkane sulfate, sulfonated co-polymer, and sulfonated polystyrene;

an effective amount of an emollient selected from the group consisting of glycerine, propylene glycol, sucrose distearate, tocopherol, polyethylene glycol succinate, oil of egg, wheat germ oil, lanolin alcohol, ethoxylated lanolin, isopropyl palmitate, ethoxylated sterol, ethoxylated glucose derivative, polyoxylated glucose derivative, isopropyl stearate, non-linear alcohols having about 7 to about 28 carbon atoms, alkoxylated lanolin, PEG 15-50 hydrogenated lanolin, PPG 15-50 hydrogenated lanolin, calcium stearoyl lactylate; cetyl octanoate, myreth-3-laurate, PEG 5-25 caprylic glyceride, PPG 5-25 capric glyceride, PPG 5-25 caprylic glyceride, polyoxyethylene cholesterol, ethoxylated glycol, sucrose cocoate, and cetyl alcohol;

an effective amount of an emulsifier selected from the group consisting of disodium ethoxylated nonyl phenol half ester of sulfosuccinic acid, hydrogenated castor oil, PEG 60, sodium dodecyl diphenyloxide disulfonate, tocopherol polyethylene glycol 1000 succinate, polysorbate 80, and P.O.E. 20 sorbitan monooloate;

an effective amount of an oxygen depleting substance selected from the group consisting of modified alkanolamide, modified cocoamide, fatty acid alkanolamide, aromatic phosphate ester, sulfonated coconut derivative sodium salt, and sulfonated caprylic derivative sodium salt;

an effective amount of a radical scavenger selected from the group consisting of tocopherol, phenol derivatives, p-methylamino phenol, quinone derivatives and vitamin K;

an effective amount of an oxygen competitor selected from the group consisting of polyamines, polypeptides, polyamides, polysaccharides, pyrrolidone, derivatives of pyrrolidone, pyrrole, derivatives of pyrrole, uracil, furan, derivatives of furan, guanine, EDTA, and derivatives of EDTA; and water.

2. The fire extinguishing composition of claim 1, wherein the oxygen competitor is added to the mixture in an amount of about 0.1 weight percent to about 2 weight percent.

3. The fire extinguishing composition of claim 1, wherein the emollient is added in an amount of about 0.8 weight percent to about 10 weight percent.

4. The fire extinguishing composition of claim 1, wherein the oxygen depleting substance is added to the mixture in an amount of about 0.2 weight percent to about 5 weight percent.

5. The fire extinguishing composition of claim 1, wherein the emulsifier is added in an amount of about 0.8 weight percent to about 10 weight percent.

6. The fire extinguishing composition of claim 1, wherein the radical scavenger is added in an amount of about 0.2 weight percent to about 5 weight percent.

7. The fire extinguishing composition of claim 1, wherein the dispersant is added in an amount of about 0.8 weight percent to about 10 weight percent.

8. The fire extinguishing composition of claim 1, said composition further comprising:

an effective amount of a coolant selected from the group consisting of ethylene glycol, propylene glycol, polypropylene glycol, polyethylene glycol, large organic alcohols having 8 or more carbon atoms, and 2-ethylhexyl alcohol.

9. The fire extinguishing composition of claim 8, wherein the coolant is added to the mixture in an amount of about 2 weight percent to about 25 weight percent.

10. A method of controlling flammability in a flammable material comprising:

applying the composition of claim 1 to said flammable material.

11. The method according to claim 10, wherein a substantially continuous layer of said composition is provided substantially co-incident with the surface area of the flammable material.

* * * * *